US009696016B2

(12) United States Patent
Alfier et al.

(10) Patent No.: US 9,696,016 B2
(45) Date of Patent: Jul. 4, 2017

(54) LIGHTING DEVICE AND CORRESPONDING METHOD

(71) Applicant: OSRAM GmbH, Munich (DE)

(72) Inventors: Alberto Alfier, Vedelago (IT); Simon Bobbo, Chirignago (IT)

(73) Assignee: OSRAM GmbH, Munich (DE)

( * ) Notice: Subject to any disclaimer, the term of this patent is extended or adjusted under 35 U.S.C. 154(b) by 18 days.

(21) Appl. No.: 14/864,979

(22) Filed: Sep. 25, 2015

(65) Prior Publication Data

US 2016/0091178 A1 Mar. 31, 2016

(30) Foreign Application Priority Data

Sep. 26, 2014 (IT) ..... TO2014A0768

(51) Int. Cl.

| | |
|---|---|
| ***F21V 19/00*** | (2006.01) |
| ***F21V 3/00*** | (2015.01) |
| ***F21K 99/00*** | (2016.01) |
| ***F21V 3/04*** | (2006.01) |
| ***F21V 15/01*** | (2006.01) |
| ***F21S 4/22*** | (2016.01) |
| ***F21K 9/00*** | (2016.01) |
| *F21V 31/00* | (2006.01) |
| *F21K 9/90* | (2016.01) |
| *F21Y 103/10* | (2016.01) |
| *F21Y 115/10* | (2016.01) |

(52) U.S. Cl.

CPC ..... *F21V 19/008* (2013.01); *F21K 9/00* (2013.01); *F21S 4/22* (2016.01); *F21V 3/00* (2013.01); *F21V 3/0445* (2013.01); *F21V 15/013* (2013.01); *F21K 9/90* (2013.01); *F21V 31/005* (2013.01); *F21Y 2103/10* (2016.08); *F21Y 2115/10* (2016.08)

(58) Field of Classification Search

CPC ..... F21V 3/0445; F21V 15/012; F21K 9/00

See application file for complete search history.

(56) References Cited

U.S. PATENT DOCUMENTS

2005/0242452 A1 11/2005 Takase et al.

FOREIGN PATENT DOCUMENTS

DE EP 1691131 A1 * 8/2006 ..... B60Q 1/26
DE 102012214484 A1 2/2014

(Continued)

OTHER PUBLICATIONS

Italian Search Report based on Application No. TO2014A000768 (7 Pages) dated May 22, 2015 (Reference Purpose Only).

(Continued)

*Primary Examiner* — Elmito Breval

(74) *Attorney, Agent, or Firm* — Viering, Jentschura & Partner mbB

(57) ABSTRACT

A lighting device may include a channel-shaped elongated profiled body including a light permeable material and having a mouth portion, and a light radiation source assembly arranged at the mouth portion and including a support board having one or more electrically powered light radiation sources, e.g. LED light radiation sources, thereon facing profiled body. Mouth portion of profiled body includes shoulder formations arranged sidewise of said mouth portion, with support board abutting against said shoulder formations.

10 Claims, 2 Drawing Sheets

(56) References Cited

FOREIGN PATENT DOCUMENTS

| | | | |
|---|---|---|---|
| EP | 1691131 | A1 | 8/2006 |
| WO | 2015193015 | A2 | 12/2015 |

OTHER PUBLICATIONS

European Search Report based on Application No. 15 185 736A(12 pages) dated Jan. 25, 2016 (Reference Purpose Only).
European Office Action based on application No. 15 185 736.4-1757 (8 pages) dated Jan. 2, 2017 (Reference Purpose Only).

* cited by examiner

LIGHTING DEVICE AND CORRESPONDING METHOD

CROSS-REFERENCE TO RELATED APPLICATION

This application claims priority to Italian Patent Application Serial No. TO2014A000768, which was filed Sep. 26, 2014, and is incorporated herein by reference in its entirety.

TECHNICAL FIELD

Various embodiments may generally relate to lighting devices.

One or more embodiments may refer to lighting devices employing solid state light radiation sources such as, for example, LED sources.

BACKGROUND

Lighting devices are available on the market which are implemented as flexible linear modules.

Such devices are also available in a "protected" version, wherein a flexible light radiation source assembly is embedded into a flexible case, adapted to be made e.g. of polymer materials. The case is adapted to protect the light radiation source assembly (light engine) from the outer environment, without significantly affecting the performance thereof as regards light output performance.

In such devices, the individual light radiation sources (e.g. LEDs) are visible in the near field, i.e. when they are observed from a short distance. This event is considered negative, because it reduces the pleasantness and comfort perceived while observing light radiation.

At an indirect observation, the light radiation emission appears as irregular, with a higher luminance at LED positions and darker areas between them. This effect is considered unpleasant, for example in wall washing and cove lighting applications, wherein the light engine is arranged near the reflecting/diffusive wall surface.

The need is increasingly felt on the market to create protected modules adapted to provide a diffused lighting. In order to achieve this result, the case may be so structured as to be adapted to perform a luminance homogenization on the outer surface of the device, through a mixing of the light radiations emitted by the single sources. In this way it is possible to make the locations of LEDs less perceivable also at a short distance.

In various implementations, such a lighting device or module may be implemented so as to be able to bend up-down (or front-back): for example, it is possible to arrange the light radiation sources on a support board (for example a Printed Circuit Board or PCB) arranged horizontally within the case, the light radiation being emitted vertically.

Devices of this kind may be implemented, for example, by laminating the support board (e.g. the PCB) onto an extruded profile. Such a profile may be made of a diffusive polymer material, adapted to scatter light and provide the desired diffused appearance in near field.

The lamination may be carried out with a transparent glue, the position of the light radiation source assembly with respect to the extruded profile being determined by the amount of adhesive material, or through a conveyor supporting the components being carried in the production line.

By adopting the first solution, possible variations of the amount of glue may modify the distance of the support board from the profile. The second solution requires a rather close monitoring of the production line.

In order to avoid light spillage from the sides of the device, opaque side walls may be used which can be designed as inserts, which are extruded together with the central portion of the extruded profile. A possible change in the light radiation source assembly, for example deriving from a substitution of components (LED light radiation sources, drivers, etc.) may cause a variation of the available volume for the laminating glue and ultimately affect the final result.

Another possible solution is exemplified in DE 1020 12214484 A1.

SUMMARY

Various embodiments may achieve one or more of the following advantages:

in a diffusive linear flexible module, a linear flexible light engine may be laminated onto an extruded profile by making use of a mechanical reference, in order to determine the relative distance on the profiled element itself, lamination may be performed onto an extruded profile, thus reducing the impact of process features (e.g. the amount of adhesive material), light radiation sources of different heights may be used without significantly affecting light output performance, even if no glue is used.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

Figure 1:
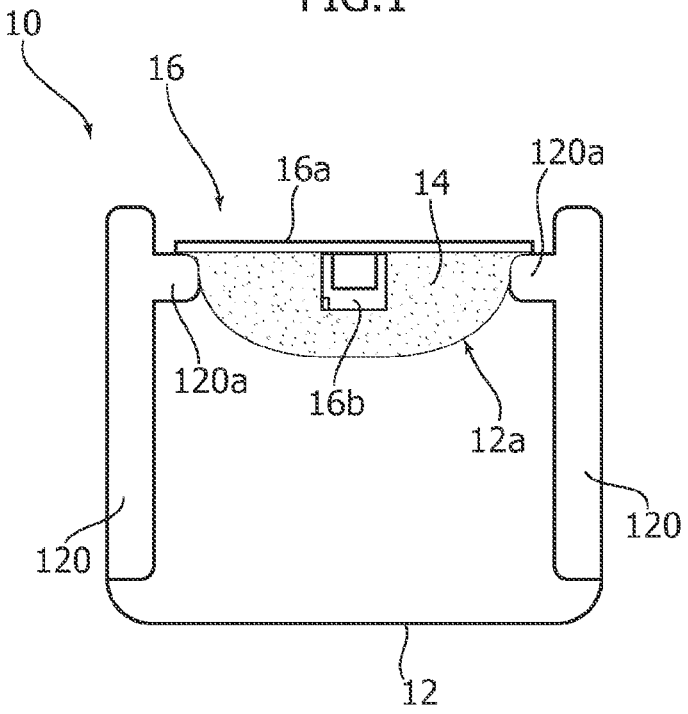
FIG. 1 is a cross-section view of a lighting device according to various embodiments.

In the following description, numerous specific details are given to provide a thorough understanding of one or more exemplary embodiments. The embodiments may be practiced without one or several specific details, or with other methods, components, materials, etc. In other instances, well-known structures, materials, or operations are not shown or described in detail to avoid obscuring various aspects of the embodiments. Reference throughout this specification to "one embodiment" or "an embodiment" means that a particular feature, structure, or characteristic described in connection with the embodiment is included in at least one embodiment. Thus, the possible appearances of the phrases "in one embodiment" or "in an embodiment" in various places throughout this specification are not necessarily all referring to the same embodiment. Furthermore, particular features, structures, or characteristics may be combined in any suitable manner in one or more embodiments, and/or may be associated to the embodiments in a different way from what is shown herein, so that e.g. a feature herein exemplified in connection to a Figure may be applied to one or more embodiments exemplified in a different Figure.

The headings provided herein are for convenience only, and therefore do not interpret the scope or meaning of the embodiments.

In the Figures, reference 10 denotes a lighting device adapted to be implemented, in one or more embodiments, as an elongated module (e.g. a bar or a strip) which may be flexible and/or adapted to be cut to length according to the application and use requirements.

As far as the present description is concerned, device 10 may therefore be considered as an element of indefinite length shown in the views of FIGS. 1 to 4 (and, as regards one of the components, FIG. 5) in cross section to the main extending direction.

In one or more embodiments, device 10 may include an elongated profiled body 12 adapted to have a mouth portion 12*a* comprised between two lateral sides, which may be defined by two inserts 120 extending lengthwise of body 12 along the channel-shaped sides.

In various embodiments, the central part of body 12 and the inserts 120 may be produced in a single co-extrusion step.

In various embodiments, body 12 may include a light permeable, i.e. transparent, material, the lateral inserts 120 made of a light impermeable, e.g. opaque and optionally white material.

In various embodiments, both body 12 and lateral inserts 120 may be made of a polymer material (e.g. silicone), the opaqueness of inserts 120 being given by the presence of a filling material such as alumina ($Al_2O_3$). Such a filling material may optionally and additionally be embedded in the portion of body 12 which is permeable to light (in a lower percentage than the amount of filling adapted to make inserts 120 opaque) so as to impart body 12 features of diffusiveness towards light radiation.

In various embodiments, mouth portion 12*a* of profile 12 may house, possibly with the interposition of a layer of a light permeable polymer material 14, a light radiation source assembly (light engine) 16.

In various embodiments, assembly 16 may include:

a support board 16*a*, which can substantially be considered as a Printed circuit Board (PCB), and one or more electrically powered light radiation sources 16*b*, arranged on the side of support board 16*a* facing profiled body 12.

In various embodiments, sources 16*b* may be solid state light radiation sources, such as LED light radiation sources.

In various embodiments, both the body 12 (including the lateral inserts 120) and the light radiation source assembly 16 may be made flexible, for example in an up/down direction with respect to the viewpoint of the Figures.

In use, the light radiation emitted by source(s) 16*b* is directed towards the body 12 of light permeable material (which may have light diffusiveness features) so as to be emitted by device 10 at the face of profile 12 opposed to mouth portion 12*a*.

Lateral inserts 120, moreover, thanks to their opaqueness (impermeability to light radiation) and optional white colour, cooperate in directing the light radiation emitted by light radiation source assembly 16 towards said output face.

Thanks to the possible diffusiveness of the material included, body 12 is adapted to perform a homogenization action on the light radiation passing through it, so as to make the position of light radiation sources 16*b* less perceivable also at short distance.

In various embodiments, as exemplified in FIGS. 1 to 4, lateral inserts 120 may have protuberances 120*a* which extend (in a continuous or discontinuous way along the lengthwise contour of device 10) towards the inside of profiled body 12, so as to form shoulders against which the support board 16*a* of the light radiation source assembly 16 is adapted to abut.

In various embodiments, the profile of body 12 may be shaped (see for example FIG. 5, but the same shape may be adopted in the embodiments exemplified in FIGS. 1 to 4 as well) so as to be recessed at the mouth portion 12*a*. In this way, irrespective of the presence of material 14 in the recessed part, a convex surface can be created (the convexity facing towards the inside of body 12) through which the light radiation emitted by source(s) 16*b* flows inside body 12.

The shoulders formed by protuberances 120*a* on both sides of mouth portion 12*a* are adapted to act as a mechanical reference for mounting light radiation source assembly 16, with support board 16*a* abutting against such shoulders irrespective of the size of light radiation source(s) 16*b*.

As a consequence, while being able to influence the amount of mounting (lamination) material 14 which may be arranged in the above mentioned recessed part, the use of different light radiation sources (and/or components such as associated drivers), which involves a change in the volume defined with respect to the recessed profile of mouth portion 12*a*, does not affect the position of board 16*a*.

Said position, actually, is defined by the board sides, which abut against protuberances 120*a*.

Moreover, the possibility is given to avoid air bubbles or the application of an excessive amount of material 14.

Figure 2:
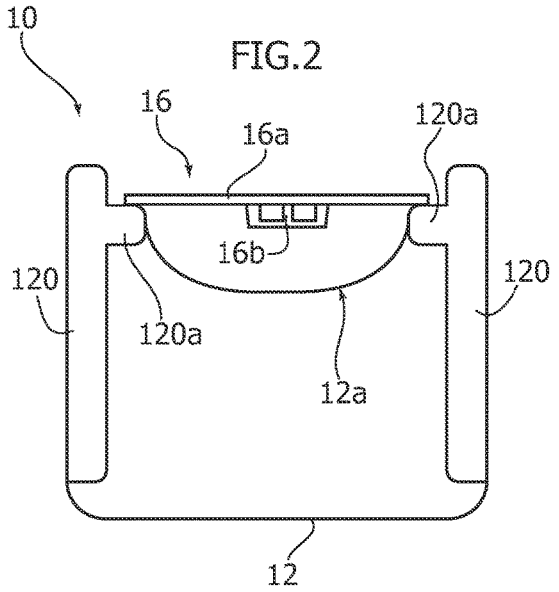
FIGS. 2 to 4 show possible implementing variations of the device of FIG. 1.
Figure 3:
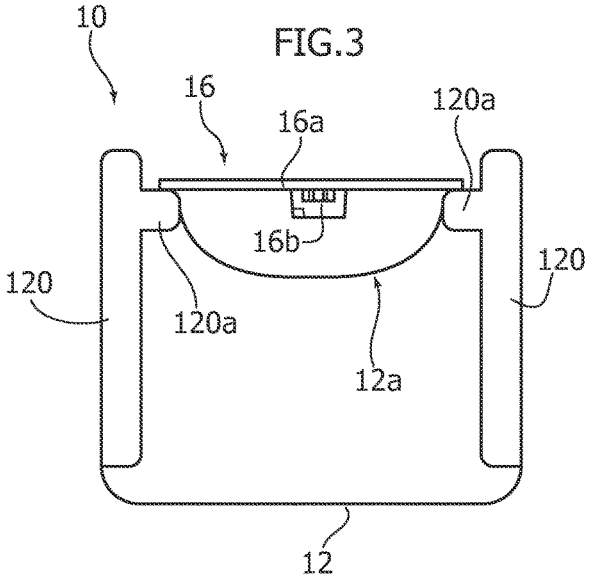
Figure 4:
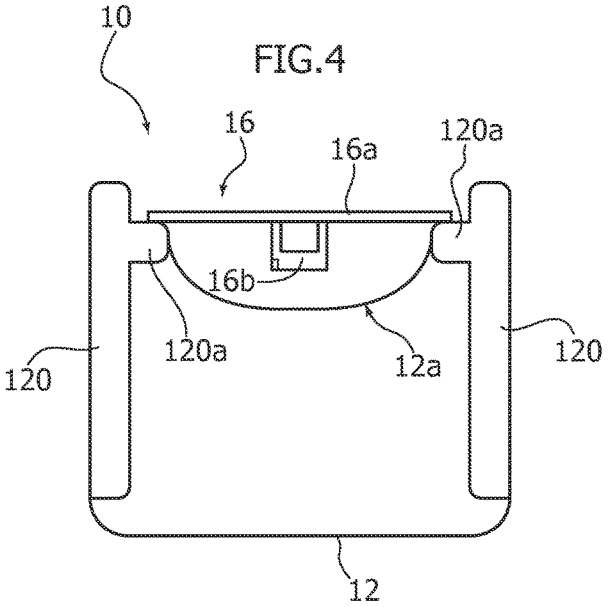

FIGS. 2 to 4 exemplify what previously stated referring to light radiation sources 16*b* which are intentionally shown as having different shapes and/or sizes.

FIGS. 1 to 4 highlight the fact that in the various embodiments exemplified herein the light radiation produced by assembly 16 always covers the same kind of path (source 16*b*—material 14 (if present)—light permeable portion permeable of body 12) without having to propagate through an air gap of a relevant thickness.

Various embodiments enable to maintain the thickness of support board 16*b* constant, with the consequent possibility to keep the same kind of electrical connectors (not visible in the Figures).

It will moreover be appreciated that the optional absence of lamination material above light radiation sources 16*b* makes the devices less sensitive to a possible variation of performances, in the case of a change of the type of light radiation source 16*b*. Actually, it is possible to minimize Fresnel optical losses by reducing the angle of incidence of light rays from light radiation sources 16*b*, as can be seen in FIGS. 2 to 4.

Figure 5:
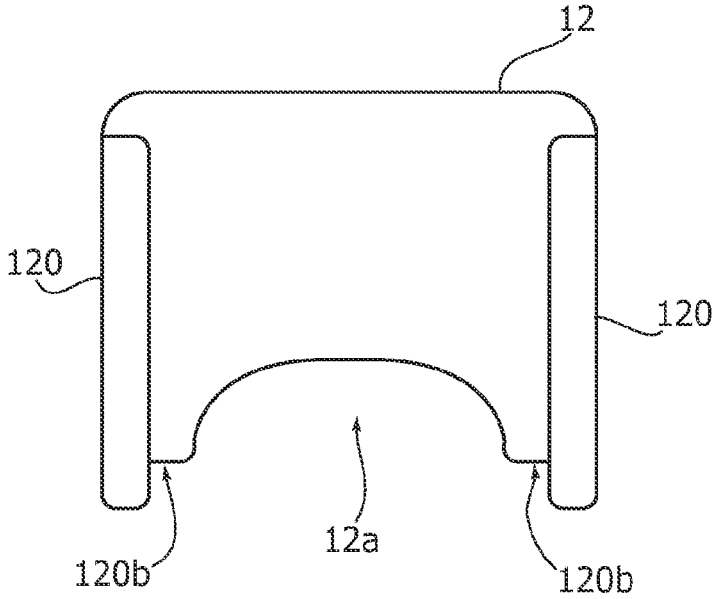
FIG. 5 shows a further possible implementing variation of one of the elements constituting a device, as exemplified in FIGS. 1 to 4.

FIG. 5 exemplifies the possibility to implement the abutment shoulders for board 16*b* by providing lateral inserts 120 having distal portions protruding with respect to mouth portion 12*a* of the profiled body. This generates, on either side of the recessed portion of mouth 12*a*, two "horns" 120*b*, which again are adapted to form lateral shoulders having abutment surfaces for support board 16*a*.

Various embodiments as exemplified in FIG. 5 are adapted to further simplify the extrusion process of profiled body 12.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A lighting device, comprising:

a flexible channel-shaped elongated profiled body including a light permeable material, said flexible channel-shaped profiled body having a mouth portion, wherein said light permeable material of said flexible channel-shaped elongated profiled body is recessed at said mouth portion creating a convex surface in said flexible channel-shaped elongated profiled body, the convexity facing towards an inside surface of the flexible channel-shaped elongated profiled body; and a flexible light radiation source assembly arranged at said mouth portion and including a support board having at least one electrically powered light radiation source thereon facing said profiled body, wherein said light radiation source assembly defines a volume with respect to the recessed profile of the mouth portion of said profiled body; and;

wherein said profiled body includes two lateral inserts extending lengthwise of said elongated profiled body;

wherein said profiled body includes shoulder formations sidewise of said mouth portion with said support board abutting against said shoulder formations.

2. The lighting device of claim 1, wherein said lateral inserts include a light impermeable.

3. The lighting device of claim 2, wherein said lateral inserts have protuberances protruding inwardly of the profiled body to provide said shoulder formations.

4. The lighting device of claim 2, wherein said lateral inserts include distal portions protruding with respect to said mouth portion away from said profiled body to form said shoulder formations.

5. The lighting device of claim 1, wherein said lateral inserts have protuberances protruding inwardly of the profiled body to provide said shoulder formations.

6. The lighting device of claim 1, wherein said lateral inserts include distal portions protruding with respect to said mouth portion away from said profiled body to form said shoulder formations.

7. The lighting device of claim 1, including a filling of a light permeable mounting material between said at least one light radiation source and said light permeable material recessed at said mouth portion.

8. The lighting device of claim 1, wherein said light permeable material of said profiled body is of a light diffusive type.

9. The lighting device of claim 1, wherein said at least one light radiation source is a LED source.

10. A method of producing a lighting device, comprising:

providing a flexible channel-shaped elongated profiled body including a light permeable material, said channel-shaped profiled body having a mouth portion, recessing the light permeable material of said profile body at the mouth portion creating a convex surface, the convexity facing towards an inside surface of the flexible channel-shaped profiled body;

arranging at said mouth portion a flexible light radiation source assembly including a support board having at least one electrically powered light radiation source thereon facing said profile body, defining a volume with respect to the recessed profile of the mouth portion of said profiled body using the flexible light radiation source assembly;

extending two lateral inserts lengthwise along the elongated profiled body;

providing said profiled body with shoulder formations sidewise of said mouth portion, and bringing said support board to abut against said shoulder formations.

* * * * *